US010030667B2

(12) United States Patent
Pirouzpanah et al.

(10) Patent No.: US 10,030,667 B2
(45) Date of Patent: Jul. 24, 2018

(54) CENTRIFUGAL BLOWER WHEEL FOR HVACR APPLICATIONS

(71) Applicant: Regal Beloit America, Inc., Beloit, WI (US)

(72) Inventors: Sahand Pirouzpanah, Troy, OH (US); Sylvia (Yuan) Feng, Fort Wayne, IN (US); Paul Nathanael Selking, Ossian, IN (US); Shirish Vatkar, Tipp City, OH (US); Joseph Henry, Dayton, OH (US); Rajavel Balaguru, Tipp City, OH (US)

(73) Assignee: REGAL BELOIT AMERICA, INC., Beloit, WI (US)

( * ) Notice: Subject to any disclaimer, the term of this patent is extended or adjusted under 35 U.S.C. 154(b) by 344 days.

(21) Appl. No.: 15/046,129

(22) Filed: Feb. 17, 2016

(65) Prior Publication Data

US 2017/0234323 A1 Aug. 17, 2017

(51) Int. Cl.

| | |
|---|---|
| ***F04D 29/28*** | (2006.01) |
| ***F04D 25/08*** | (2006.01) |
| ***F04D 29/30*** | (2006.01) |
| ***F04D 29/42*** | (2006.01) |

(52) U.S. Cl.

CPC ..... *F04D 29/283* (2013.01); *F04D 25/08* (2013.01); *F04D 29/30* (2013.01); *F04D 29/424* (2013.01); *F04D 29/282* (2013.01)

(58) Field of Classification Search

CPC ..... F04D 29/30; F04D 29/282; F04D 29/283
See application file for complete search history.

(56) References Cited

U.S. PATENT DOCUMENTS

| | | | | |
|---|---|---|---|---|
| 3,921,272 | A | 11/1975 | Klonoski | |
| 5,988,979 | A | 11/1999 | Wang | |
| 6,007,300 | A * | 12/1999 | Saeki | F04D 29/283 416/178 |
| 6,685,433 | B2 * | 2/2004 | Kim | F04D 29/282 415/206 |
| 6,769,876 | B2 * | 8/2004 | Sakai | F01D 1/02 415/206 |
| 7,210,907 | B2 * | 5/2007 | Patti | F04D 29/282 416/178 |
| 8,011,891 | B2 * | 9/2011 | Ochiai | F04D 29/282 416/188 |
| 8,454,316 | B2 * | 6/2013 | Svensson | F04D 29/30 416/185 |
| 8,881,396 | B2 | 11/2014 | Hall et al. | |
| 9,022,732 | B2 * | 5/2015 | Prunieres | F04D 29/026 415/206 |
| 9,039,362 | B2 * | 5/2015 | Fukuda | F04D 25/0613 415/206 |
| 2006/0051202 | A1 | 3/2006 | Patti | |
| 2007/0217908 | A1 | 9/2007 | Ochiai et al. | |
| 2010/0150721 | A1 | 6/2010 | Svensson | |

(Continued)

*Primary Examiner* — Justin Seabe
*Assistant Examiner* — Behnoush Haghighian
(74) *Attorney, Agent, or Firm* — Thompson Coburn LLP; Alan H. Norman

(57) ABSTRACT

A forward curved blower wheel has fan blades having relatively small leading edge blades angles and a relatively lengthy mean camber lines. The blower wheel also comprises leading edge notches adjacent its blower wheel inlet. The leading edge notches eliminate buffeting that would occur with such blades if such notches were not present.

24 Claims, 12 Drawing Sheets

(56) References Cited

U.S. PATENT DOCUMENTS

| | | | | |
|---|---|---|---|---|
| 2012/0201680 | A1 | 8/2012 | Hall et al. | |
| 2016/0153457 | A1* | 6/2016 | Jang | B60H 1/00471 415/204 |

* cited by examiner

CENTRIFUGAL BLOWER WHEEL FOR HVACR APPLICATIONS

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable.

BACKGROUND OF THE INVENTION

Field of the Invention

The present invention pertains generally to centrifugal fans/blower wheels of the type used in HVACR (heating/ventilation/air-conditioning/refrigeration) equipment. More specifically, the present invention pertains to forward-curved centrifugal blower wheels having a unique fan blade configuration that provides improved efficiency over prior art blower wheels.

General Background

Centrifugal blower wheels (sometimes called "squirrel cage" blowers or fans) are commonly used in HVACR equipment to generate air flow. Such blower wheels are typically formed of plastic or metal and comprise a plurality of fan blades circumferentially spaced about the axis of fan rotation. In most cases, the opposite ends of the fan blades are attached to each other via a ring, disk, or plate or some other form of divider or end member. Examples of such include the blower wheels disclosed in U.S. Pat. Nos. 8,881,396 and 5,988,979.

Centrifugal blowers operate by drawing air or other gas axially into the blower wheel parallel to the axis of rotation, and expelling such air or gas through the fan blades via the centrifugal force acting on the air or gas between the fan blades. Some blower wheels are open at both axial ends and are configured to draw air or gas into the blower wheel from both of its axial sides. These are referred to herein as dual inlet blower wheels. Other blower wheels are configured to draw air in from just one of their axial sides (referred to herein as single inlet blower wheels). The present invention pertains to both of such types of blower wheels.

A complete blower assembly may comprise a drive motor positioned partially or completely within the blower wheel, or completely external to the blower wheel. Still further, blower wheels may comprise forward-curved, backward-curved, or straight radial fan blades. The mean camber lines of the fan blades of a forward-curved blower wheel curve in the direction of blower wheel rotation as they extend radially outward. In contrast, backward-curved blades curve in the opposite direction as they extend radially outward. Some fan blades vary in thickness as they extend radially outward. Other fan blades (especially those formed of sheet metal) have a uniform thickness from leading to trailing edges. Regardless, the mean camber lines of the fan blades of a blower wheel define whether the blower wheel has forward-curved, backward-curved, or straight radial fan blades. The present invention pertains to all types of blower fans having forward-curved blower wheels.

It was generally known prior to the present invention that reducing the leading edge blade angle of the fan blades of a forward curved blower wheel should be more efficient. However, it was also known prior to the present invention that reducing the leading blade angle of the fan blades required greater cord length blades, and that in order to keep such a blower wheel from buffeting and operating poorly, which blower wheels having low leading edge blade angle fan blades had a strong tendency to do, the inlet ring of the blower housing had to be made smaller. The smaller inlet ring of the blower housings then offset any potential efficiency gain.

SUMMARY OF THE INVENTION

The present invention overcomes the assumed disadvantages of configuring a blower wheel with longer chord length fan blades having reduced leading edge blade angles. By adding notches in the leading edges of such blades adjacent the inlet(s) of the blower wheel, higher efficiency can be achieved. This is because even relatively small leading edge notches on such fan blades of a blower wheel adjacent the blower wheel inlet creates a uniquely high efficiency blower wheel that doesn't suffer from buffeting and that can be applied to blower assemblies having full sized and even oversized housing inlet rings.

In one aspect of the invention, a forward-curved blower wheel comprises a divider or end member and a plurality of fan blades circumferentially spaced about a fan axis. The blower wheel has a blower wheel inlet that is defined by the fan blades. Each of the fan blades has a leading edge, a trailing edge, and a mean camber line. The mean camber line extends from the leading edge to the trailing edge. The leading edges of the fan blades collectively define an inner diameter of the blower wheel and the trailing edges of the fan blades define an outer diameter of the blower wheel. The mean camber line of each of the fan blades has a blade angle that increases as the mean camber line extends from the leading edge to the trailing edge of the respective fan blade. The leading edge of each of the fan blades is a distance from the trailing edge of the fan blade. That distance constitutes a chord length. The blade angle of the mean camber line of each of the fan blades is at most seventy-seven and at least thirty degrees at the leading edge of the respective fan blade. The inner diameter, the blower wheel inlet, and the divider or end member bound an internal cavity of the blower wheel. The internal cavity has an axial width. A majority of the fan blades each comprise a first leading edge notch adjacent the blower wheel inlet. The first leading edge notch has an area greater than 0.045 and less than 0.64 times the square of the chord length within a distance equal to twenty-five percent of the axial width of the internal cavity from the blower wheel inlet.

In another aspect of the invention, a forward-curved blower wheel comprises a divider or end member and a plurality of fan blades circumferentially spaced about a fan axis. The blower wheel has a blower wheel inlet that is defined by the fan blades. Each of the fan blades has a leading edge, a trailing edge, and a mean camber line. The mean camber line extends from the leading edge to the trailing edge. The leading edges of the fan blades define an inner diameter (ID) of the blower wheel and the trailing edges of the fan blades define an outer diameter (OD) of the blower wheel. The mean camber line of each of the fan blades has a blade angle ($\alpha$, degrees) that increases as the mean camber line extends from the leading edge to the trailing edge of the respective fan blade. The blade angle of the mean camber line of each of the fan blades is at most seventy-seven and at least thirty degrees at the leading edge of the respective fan blade. The mean camber line of each of the fan blades has first and second regions. The first region is between the second region and the leading edge of the respective fan blade. The blade angle increases at an increasing rate throughout the first region of the mean camber line as the mean camber line extends away from the leading edge. The blade angle increases at a decreasing rate throughout the second region as the mean camber line extends away from the leading edge. The first region is between the second region and the leading edge of the respective fan blade. The leading edge of each fan blade is a distance from the trailing edge of said fan blade. That distance constitutes a chord length (C). The inner diameter, the blower wheel inlet, and the divider or end member bound an internal cavity of the blower wheel. The internal cavity has an axial width. The fan blades are preferably configured such that:

$$0 < \frac{[90 - \alpha \text{ (at leading edge)}] \cdot [C \text{ (in)} - 1.09] \cdot ID \text{ (in)}}{\alpha \text{ (at trailing edge)} \cdot OD \text{ (in)}} < 4,$$

The outer diameter is less than twelve inches. The product of the number of fan blades multiplied by the chord length is greater than or equal to the product of pi multiplied by the outer diameter and less than or equal to two times the product of pi multiplied by the outer diameter. A majority of the fan blades each comprise a first leading edge notch adjacent the blower wheel inlet. The first leading edge notch has an area greater than 0.045 and less than 0.64 times the square of the chord length within a distance equal to twenty-five percent of the axial width of the internal cavity from the blower wheel inlet.

In yet another aspect of the invention, a forward-curved blower wheel comprises a divider member and a first set of a plurality of fan blades circumferentially spaced about a fan axis. The blower wheel has a first blower wheel inlet that is defined by the first set of the fan blades. Each of the fan blades of the first set of fan blades has a leading edge and a trailing edge. The leading edges of the fan blades of the first set of fan blades define a first inner diameter of the blower wheel and the trailing edges of the fan blades define an outer diameter of the blower wheel. The leading edge of each of the fan blades of the first set of fan blades are a distance from the trailing edge of said fan blade. That distance constitutes a first chord length. The first inner diameter, the first blower wheel inlet, and the divider member bound a first internal cavity of the blower wheel. The first internal cavity has a first axial width. A majority of the fan blades of the first set of fan blades each comprise a first leading edge notch adjacent the first blower wheel inlet. The first leading edge notch has an area greater than 0.045 and less than 0.64 times the square of the first chord length within a distance equal to twenty-five percent of the first axial width of the first internal cavity from the first blower wheel inlet. The blower wheel comprises a second set of a plurality of fan blades circumferentially spaced about the fan axis. The second set of fan blades are axially adjacent to the first set of fan blades and the first and second sets of fan blades are the only fan blades of the blower wheel. The blower wheel comprises a second blower wheel inlet that is defined by the second set of fan blades. Each of the fan blades of the second set of fan blades has a leading edge and trailing edge. The leading edges of the fan blades of the second set of fan blades define a second inner diameter of the blower wheel that is greater than the first inner diameter. The trailing edges of the fan blades of the second set of fan blades define an outer diameter that is equal to the outer diameter defined by the first set of fan blades. The number of fan blades of the second set of fan blades is greater than the number of fan blades of the first set of fan blades.

Further features and advantages of the present invention, as well as the operation of the invention, are described in detail below with reference to the accompanying drawings.

Figure 1:
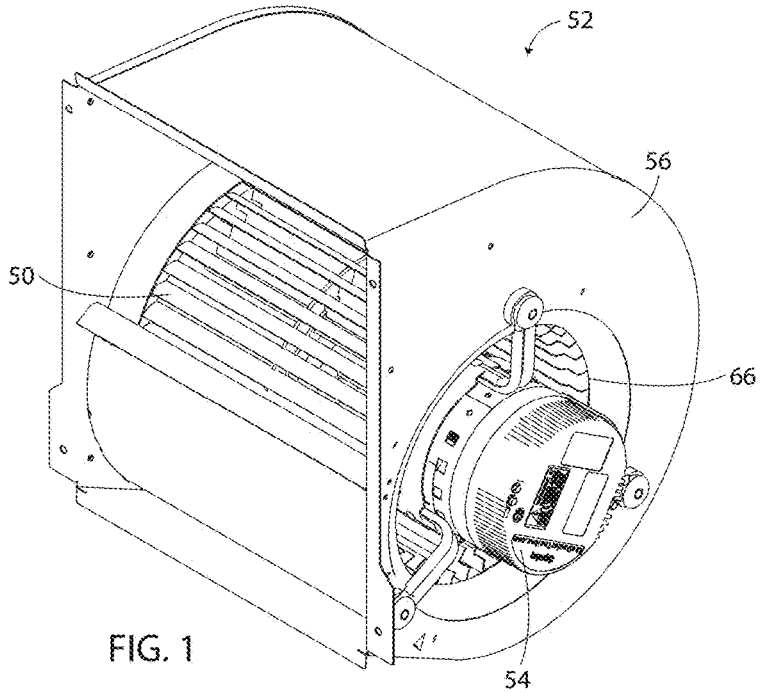
FIG. 1 depicts a perspective view of a dual inlet blower fan assembly comprising a radial motor.

Reference numerals in the written specification and in the drawing figures indicate corresponding items.

DETAILED DESCRIPTION

Figure 2:
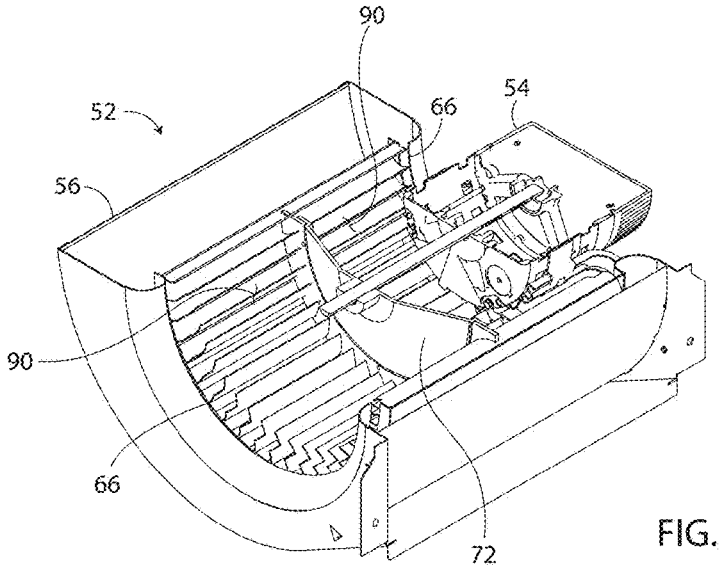
FIG. 2 depicts a cross-sectioned perspective view of the blower fan assembly shown in FIG. 1.
Figure 3:
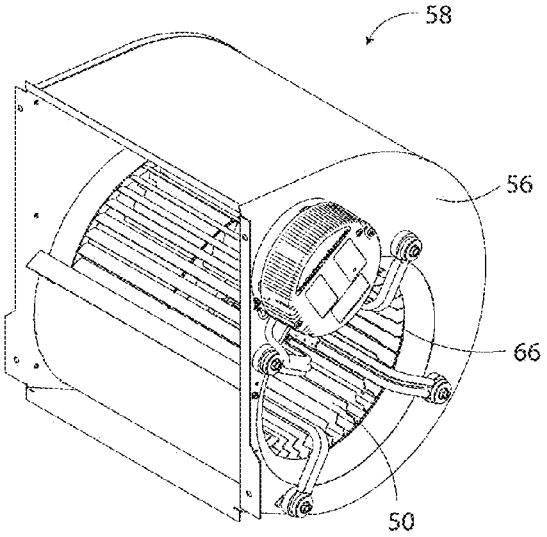
FIG. 3 depicts a perspective view of a dual inlet blower fan assembly comprising an axial motor.
Figure 4:
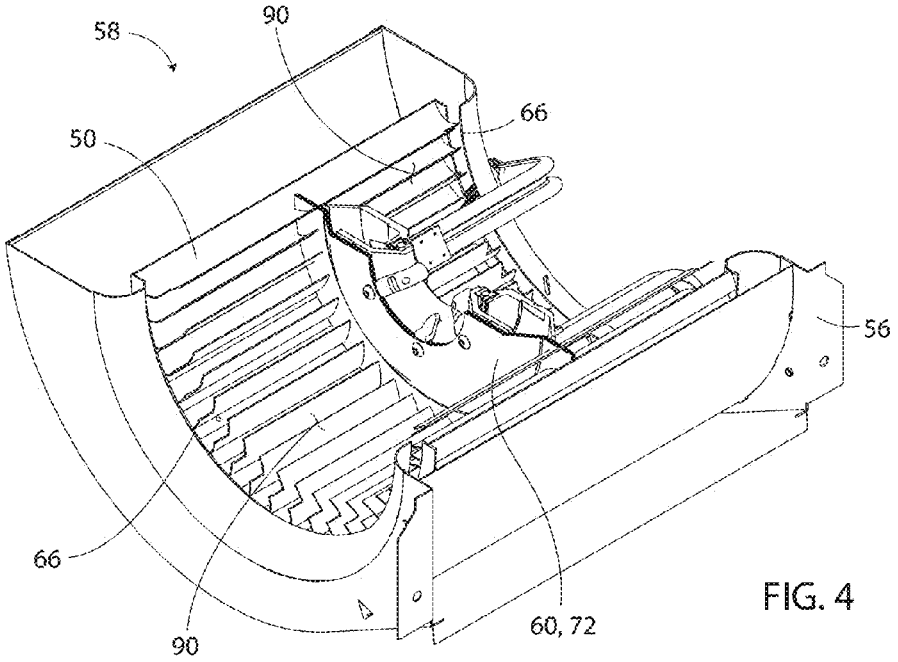
FIG. 4 depicts a cross-sectioned perspective view of the blower fan assembly shown in FIG. 3.
Figure 5:
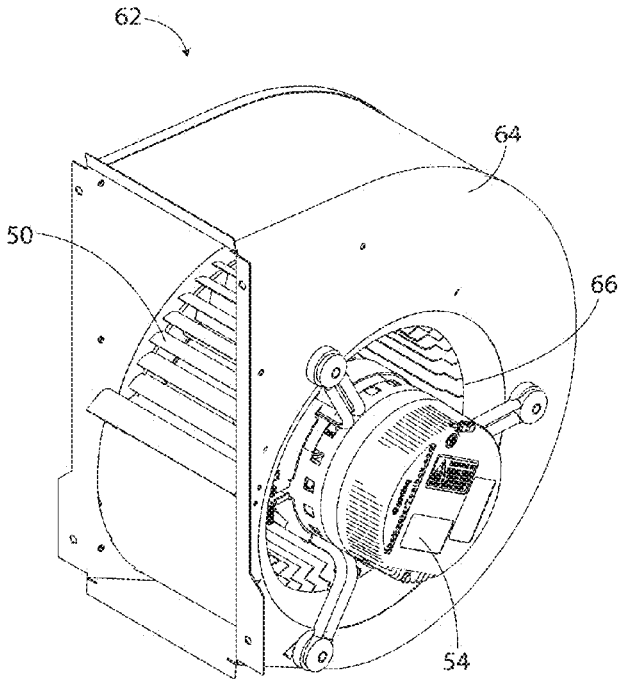
FIG. 5 depicts a perspective view of a single inlet blower fan assembly comprising a radial motor.
Figure 6:
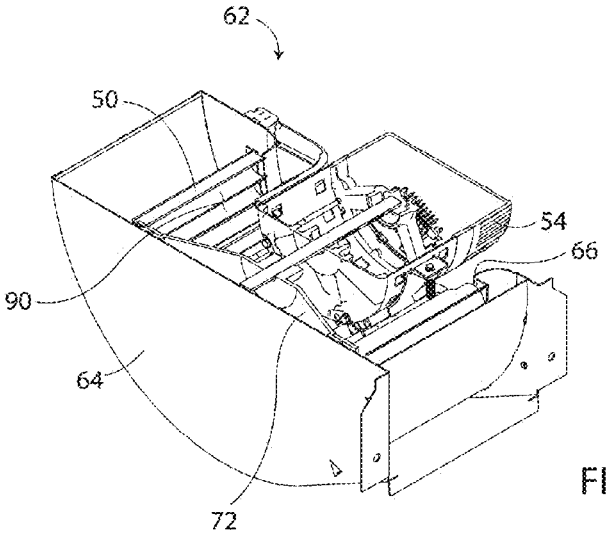
FIG. 6 depicts a cross-sectioned perspective view of the blower fan assembly shown in FIG. 5.

FIGS. 1 through 6 depict several different styles of blower fan assemblies having forward-curved blower wheels 50 in accordance with the invention. FIGS. 1 and 2 depict a blower assembly 52 comprising a radial motor 54 for rotationally driving a dual inlet blower wheel 50 in a dual inlet blower housing 56. The radial motor 54 extends only partially into the blower wheel 50. FIGS. 3 and 4 depict a blower assembly 58 comprising an axial motor 60 for rotationally driving a blower wheel 50 in a dual inlet blower housing 56. The axial motor 56 is positioned entirely within the blower wheel 50. FIGS. 5 and 6 depict a blower assembly 62 comprising a radial motor 54 for rotationally driving a blower wheel 50 in a single inlet blower housing 64. As is explained in greater detail below, the blower housing inlet(s) 66 of the blower housings 56, 64 preferably have an inner diameter that is larger than the inner diameter defined by the fan blades of the blower wheels 50. Although FIGS. 1-6 depict various styles of blower assemblies, it should be appreciated that blower wheels in accordance with this invention have advantages over other prior art blower wheels in many types of blower assemblies, even in those where the blower wheel inlet(s) of the blower wheel is not within a blower housing. Thus, FIGS. 1-6 merely depict exemplary blower assemblies in which blower wheels in accordance with the invention may be used.

Figure 10:
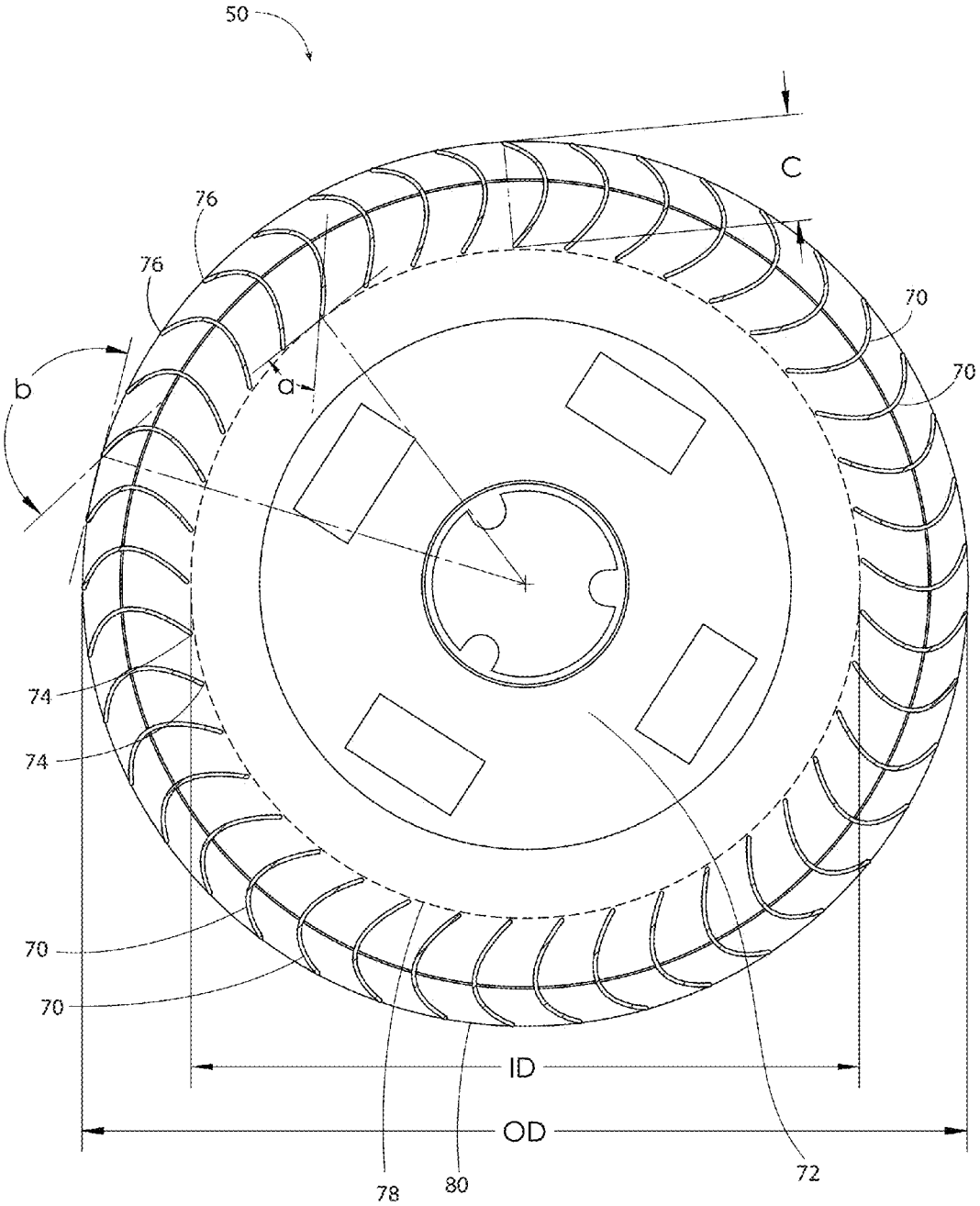
FIG. 10 depicts a cross-section of the blower wheel shown in FIG. 9, taken about a plane perpendicular to its axis of rotation.

FIG. 10 depicts a cross-sectional view of a forward-curved blower wheel 50 in accordance with the invention. In general, such a blower wheel 50 comprises a plurality of fan blades 70 that are circumferentially spaced about the axis of rotation of the blower wheel and which are connected to at least one divider or end member 72. The divider or end member 72 may be an axial motor, a plate, a spoked wheel, or some other member that operatively connects a motor to the fan blades 70 in a manner such that the motor is capable of revolving the fan blades about the axis of the blower wheel 50. Dual inlet blower assemblies 52 (such as shown in FIGS. 1-4) typically comprise a divider member 72 positioned somewhere between the opposite axial ends of the blower wheel 50. Single inlet blower assemblies 52 (such as shown in FIGS. 5 and 6) typically comprise an end member 72 positioned at an axial end of the blower wheel 50.

Figure 13:
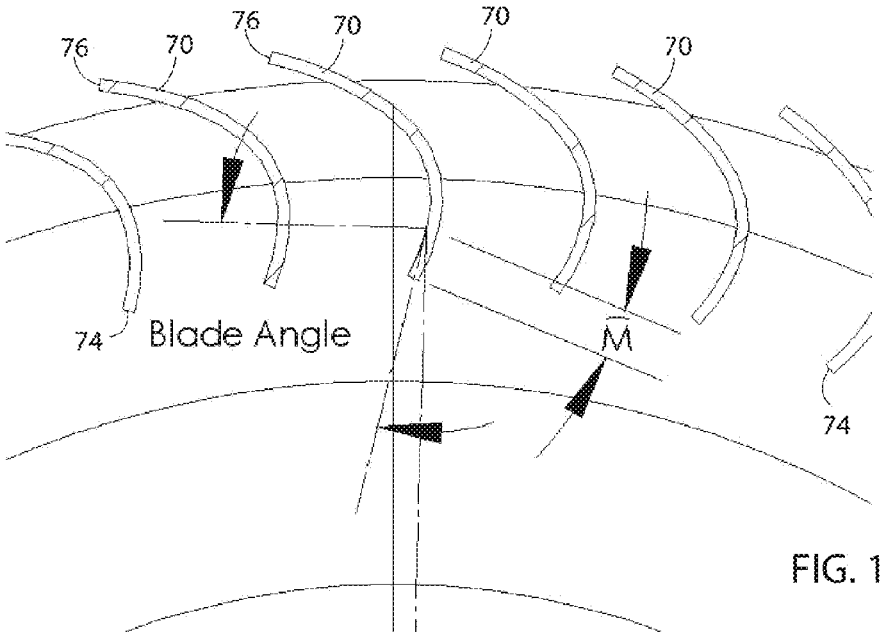
FIG. 13 is a detailed viewed of a portion of the cross-section view of FIG. 10.

The general terminology used herein to describe the configuration of a fan blade 70 of a forward-curved blower wheel 50 can best be understood with reference to FIGS. 10 and 13. Each fan blade 70 has a leading edge 74 and trailing edge 76, with the distance therebetween being known as the chord length 78 (symbolized herein as "C") of the fan blade. Between the leading edge 74 and the trailing edge 76 of the fan blade 70, the fan blade curves along a non-linear path, which is referred to herein as the "mean camber line." The mean camber line has a blade angle (symbolized herein as "α") that increases between the leading edge 74 and the trailing edge 76 of the fan blade. The blade angle of a fan blade 70 at any point along its mean camber line is the angle between a line tangent to the mean camber line at that point and a line perpendicular to a line that intersects both that point and blower wheel axis. The letters "a" and "b" in FIG. 10 represent leading edge and trailing edge blade angles respectively. As shown in FIG. 10, the leading edges 74 of a set fan blades 70 of a blower wheel 50 define an inner diameter 78 (ID) of the blower wheel and the trailing edges define an outer diameter 80 (OD).

Figure 7:
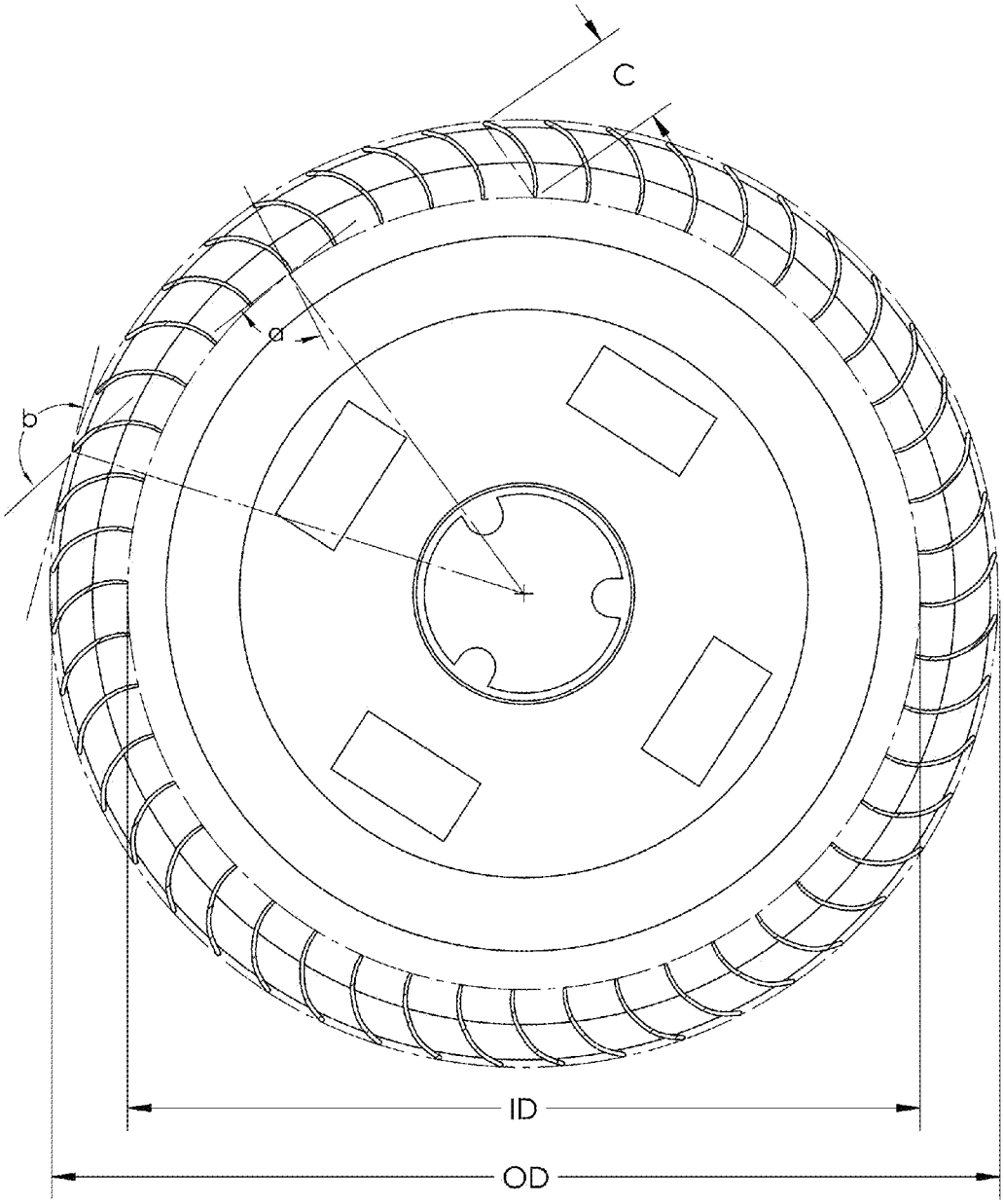
FIG. 7 PRIOR ART
FIG. 7 depicts a cross-section of a prior art blower wheel have a constant radius fan blades and is taken about a plane perpendicular to its axis of rotation.
Figure 8:
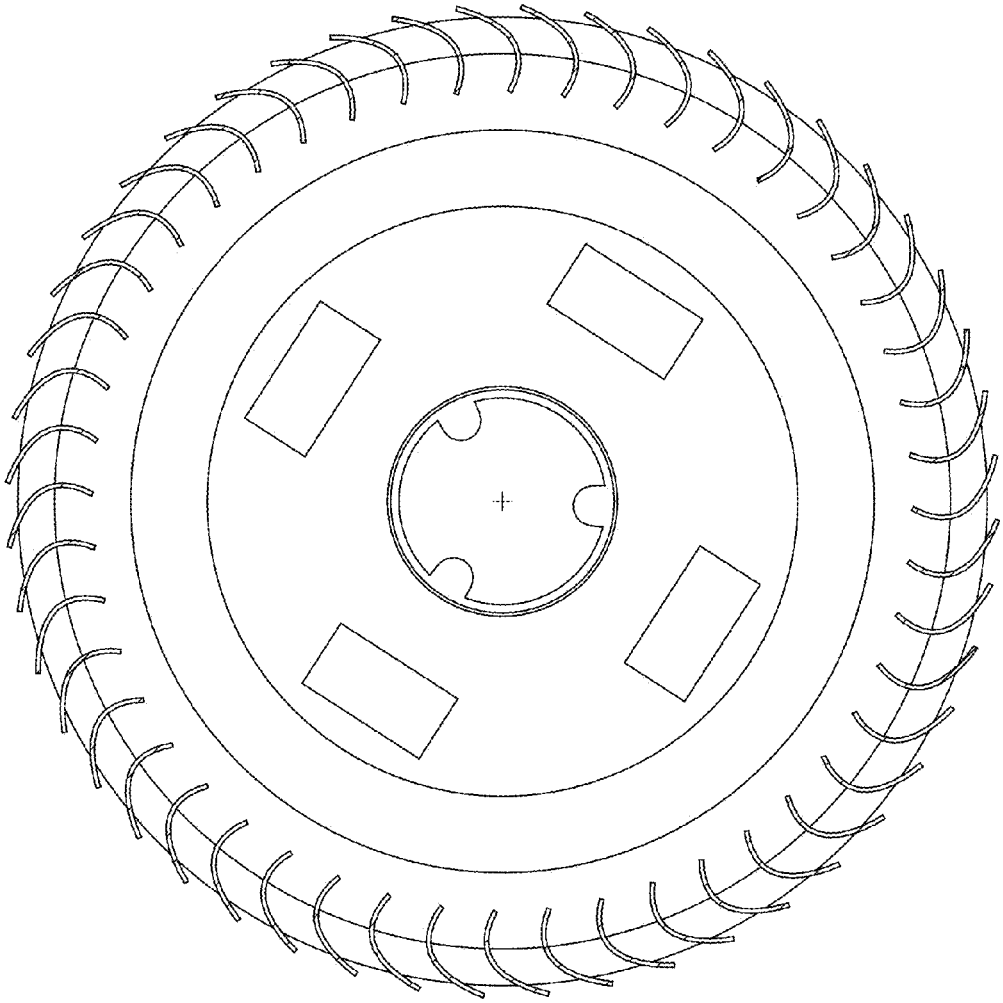
FIG. 8 PRIOR ART
FIG. 8 depicts a cross-section of a prior art blower wheel having compound radius fan blades and is taken about a plane perpendicular to its axis of rotation.
Figure 9:
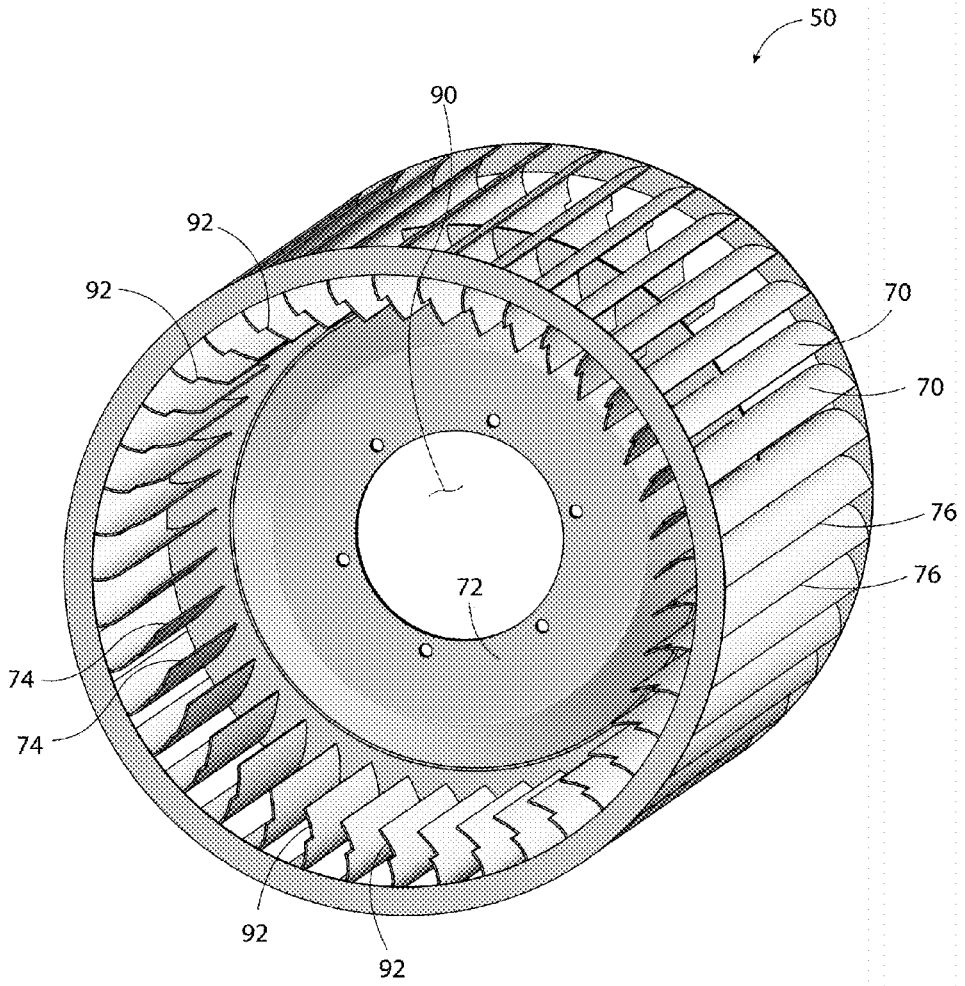
FIG. 9 is a perspective view of a single-piece symmetric blower wheel in accordance with the invention.

In contrast to the conventional fan blades of the blower wheels shown in FIGS. 7 and 8, the fan blades 70 of a blower wheel 50 in accordance with the invention has a longer mean camber line length relative to the outer diameter 80 of such blower wheel. As a result, the blower wheel 50 has a smaller than typical inner diameter 78 to outer diameter 80 ratio. Preferably, the ratio of the inner diameter of the blower wheel to the outer diameter of the blower wheel 50 is at most 0.85. However, that ratio is merely preferred rather than required.

The longer mean camber line length allows the blade angle at the leading edge 74 of each fan blade 70 to be relatively small without impacting the overall pressure generation capabilities of the fan blade. The reduced blade angle at the leading edges 74 of the fan blade 76 decreases the incidence angle of air as the air enters the spaces between the fan blades 70 and, combined with other aspects of the invention discussed herein, thereby improves the efficiency of the blower wheel 50. Preferably, the blade angle at the leading edge 74 of each fan blade 70 is between thirty and seventy-seven degrees. More preferably, the blade angle at the leading edge 74 of each fan blade 70 is between forty and fifty-five degrees (with the nominal being 47 degrees for maximum efficiency). For blower wheels 50 having an outer diameter of between eight and twelve inches, the fan blades are preferably configured such that:

$$0 < \frac{[90 - \alpha\ (\text{at leading edge})] \cdot [C\ (\text{in}) - 1.09] \cdot ID\ (\text{in})}{\alpha\ (\text{at trailing edge}) \cdot OD\ (\text{in})} < 4$$

For blower wheels having an outer diameter ranging from twelve to fifteen inches, the fan blades are preferably configured such that:

$$0 < \frac{[90 - \alpha\ (\text{at leading edge})] \cdot [C\ (\text{in}) - 1.37] \cdot ID\ (\text{in})}{\alpha\ (\text{at trailing edge}) \cdot OD\ (\text{in})} < 4$$

Figure 15:
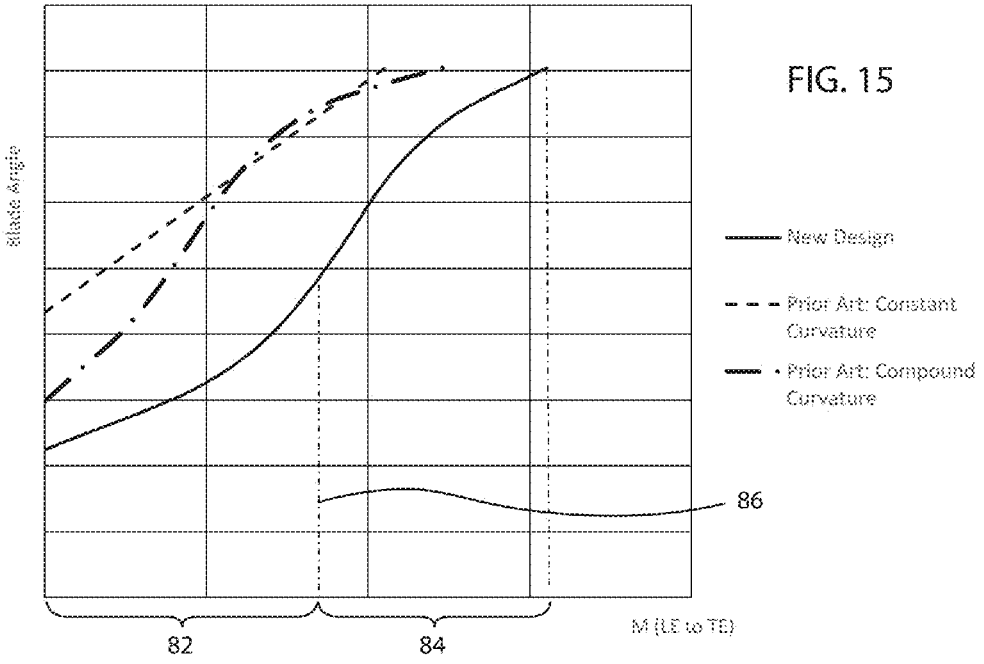
FIG. 15 is a graph of the blade angle of blower wheels as a function of the distance along the mean camber line from the leading edge for the prior art blower wheels shown in FIGS. 7 and 8 and for the blower wheel shown in FIGS. 9-13.
Figure 16:
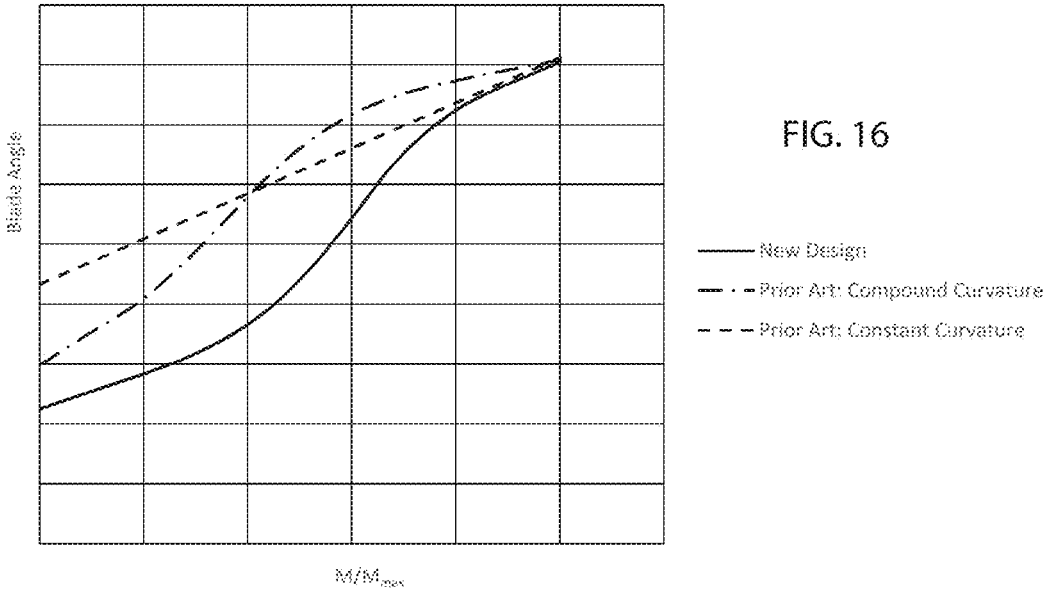
FIG. 16 is a similar graph of blade angle, but as a function of the ratio of distance along the mean camber line from the leading edge to the total length of the mean camber line.

As is shown graphically in FIG. 15, from the leading edge 74 of each fan blade 70, the blade angle of the fan blade preferably increases at an increasing rate throughout a first region of the mean camber line until reaching an inflection point 86 (in FIG. 15, "M" represents the distance along the mean camber line of the fan blade from the leading edge of the fan blade). The blade angle of the fan blade 70 preferable increases at a decreasing rate throughout a second region of the mean camber line, which preferably extends from the inflection point 82 to the trailing edge 76 of the fan blade. FIG. 16 shows the blade angle change in a similar manner except that the x-axis shows M over the total length of the mean camber line. As is apparent from FIGS. 15 and 16, the inflection point 86 preferable lies more than halfway along the mean camber line from the leading edge 74 to the trailing edge 76. More preferably, the inflection point 86 lies between 0.5 and 0.6 times the length of the mean camber line along the mean camber line from the leading edge 74.

Figure 12:
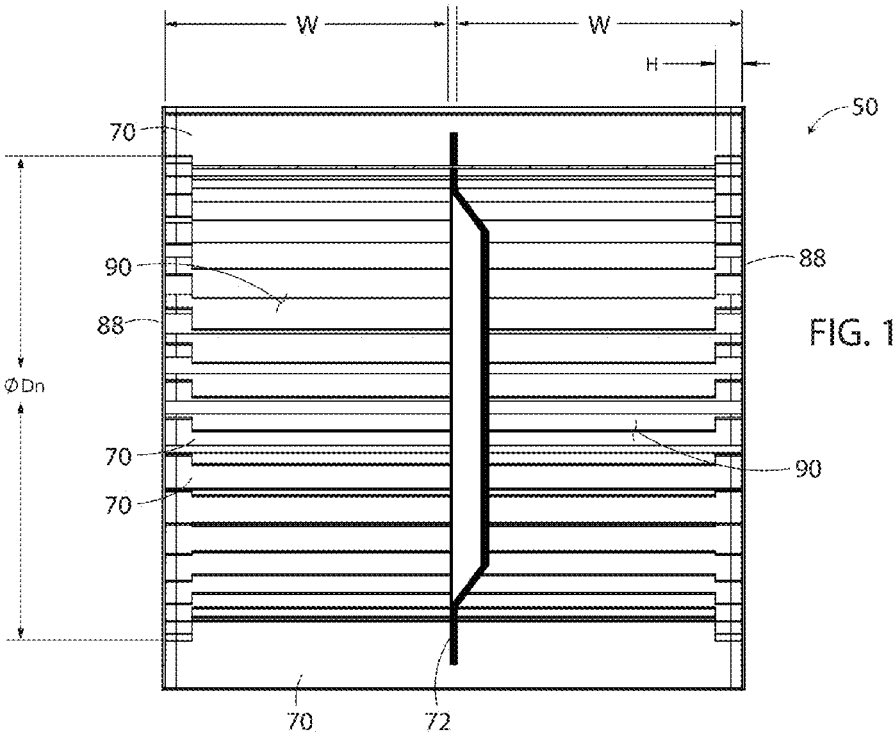
FIG. 12 is a cross-section of the blower wheel shown in FIGS. 9-10, taken about the line A-A shown in FIG. 11.

Referring to FIG. 12, a blower wheel 50 in accordance with the invention comprises at least one blower wheel inlet 88 and at least one internal cavity 90. Air enters the internal cavity 90 axially through the blower wheel inlet 88 and eventually turns radially outward between the fan blades 70. The internal cavity 90 extends axially from the blower wheel inlet 88 (which is coplanar to axial ends of the fan blades 70) to a divider or end member 72. The width of the internal cavity 90 is the distance between the respective blower wheel inlet 88 and the divider or end member 72 (shown as dimension "W" in FIG. 12). For dual inlet blower wheels, the divider member 72 may or may not be positioned centrally between the axial ends of the blower wheel 50. Thus, it should be appreciated that a blower wheel 50 may have first and second internal cavities 90 of unequal width, and of course a single inlet blower wheel 50 only comprises one internal cavity 90.

Figure 11:
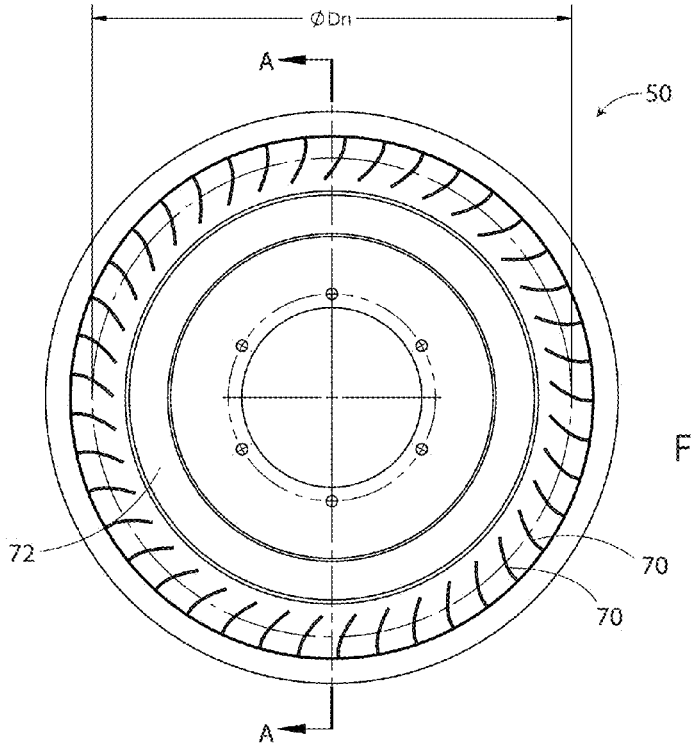
FIG. 11 is a side view of the blower wheel shown in FIGS. 9 and 10.
Figure 14:
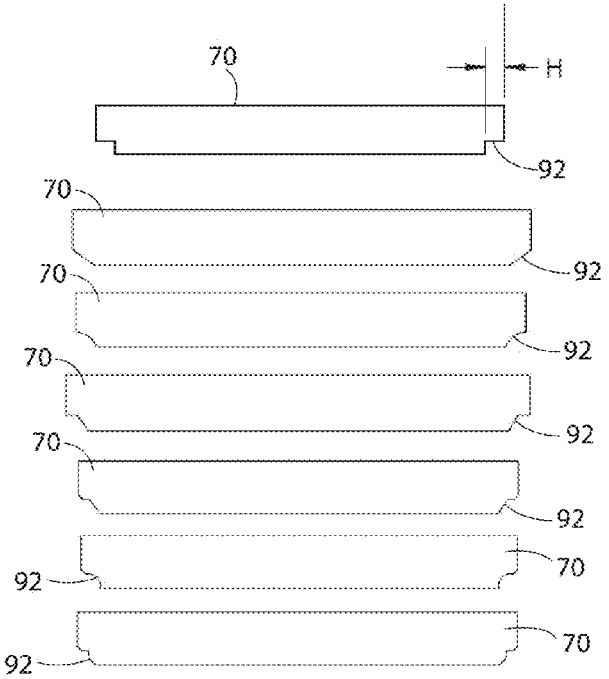
FIG. 14 shows various configurations of leading notches provided on fan blades of blower wheels in accordance with the invention.

A blower wheel 50 in accordance with the invention also comprises leading edge notches 92 in the fan blades 70 adjacent each blower wheel inlet 88. Preferably all of the fan blades 70, or at least a majority of the fan blades have leading edge notches 92. As shown in FIG. 14, the leading edge notches 92 can have a variety of shapes. However, the leading edge notches 92 are preferably rectangular. As shown in FIG. 11, the leading notches 92 preferably extend radially outward nearest the blower wheel inlet 88 at most to a diameter shown as "Dn". Preferably the ratio of diameter Dn to the outer diameter 80 of the blower wheel 50 is between 0.8 and 0.9. Each leading edge notch 92 has an area greater than 0.045 and less than 0.64 times the square of the chord length within a distance equal to twenty-five percent of the axial width of the internal cavity 90 from the blower wheel inlet 88. It should be understood and appreciated from the foregoing that the total area of leading edge notch 92 could extend beyond twenty-five percent of the axial width of the internal cavity 90 from the blower wheel inlet 88, so long as the portion of the notch within twenty-five percent of the axial width of the internal cavity from the blower wheel inlet has an area greater than 0.045 and less than 0.64 times the square of the chord length. Preferably however, the leading edge notches 92 lie entirely within twenty-five percent of the axial width of the internal cavity 90 from the blower wheel inlet 88.

The leading edge notches 92 provided on the fan blades 50 adjacent the blower wheel inlet(s) provide a significant contribution to the efficiency and overall performance of the blower wheels described herein because they stabilize the blower wheels and allow such blower wheels to be operated with non-reduced diameter blower housing inlets. It should be appreciated that air flow at the blower wheel inlet is largely axial and lacks any appreciable radial component. In the absence of the notches, such flow would cause undesirable turbulence and even buffeting as such flow strikes the long chord fan blades described herein (especially if the fan blades have a low leading edge blade angle). By providing the fan blades with the leading edge notches adjacent the blower wheel inlet, the fan blades do not encounter such largely axial air flow. However, further from the blower inlet where the flow has a significant radial component, the fan blades are able to take full advantage of having of the low leading edge blade angles. These advantages allow blower wheels in accordance with the invention to be utilized in blower housings having one or more blower housing inlet(s) of larger diameter than would be possible or practical if the fan blades lacked the leading edge notches. For example, the invention allows for such blower wheels to be utilized in blower assemblies wherein the diameter of a housing inlet squared divided by the inner diameter of the blower wheel squared is greater than 1.05.

The blower wheel 50 shown in FIGS. 9-13 is a single-piece symmetric blower wheel configured for use in a dual inlet blower assembly. Its fan blades 70 extend the full width of the blower wheel 50 and the blower wheel comprises a centrally positioned divider member 72. As such, the blower wheel 50 shown in FIGS. 9-13 comprises two blower wheel inlets 88, two internal cavities 90, and a single set of fan blades 70. Leading edge notches 92 are provided on the fan blades 70 adjacent both blower wheel inlets 88.

Figure 17:
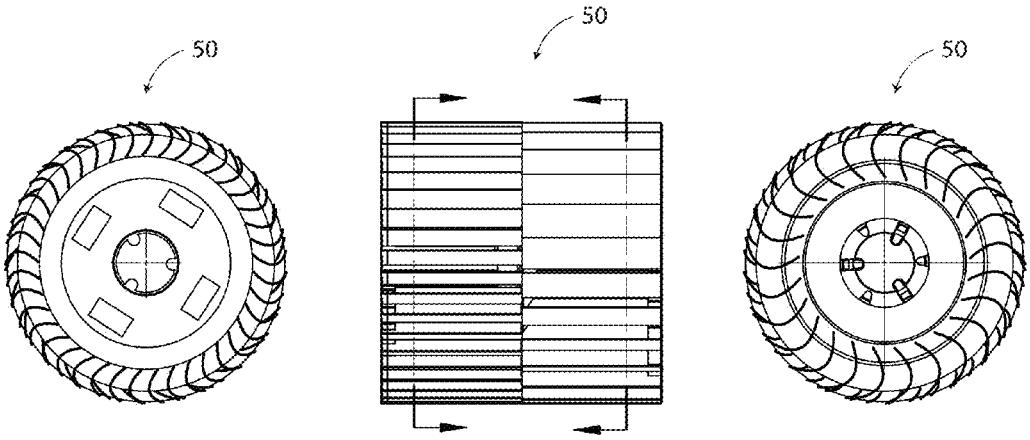
FIG. 17 depicts multiple views of a single-piece asymmetric blower wheel in accordance with the invention.

A single-piece asymmetric blower wheel 50 in accordance with the invention configured for use in a dual inlet blower assembly is shown in FIG. 17. Unlike the single-piece symmetric blower wheel of FIGS. 9-13, the single-piece asymmetric blower wheel shown in FIG. 17 comprises two sets of fan blades that are axial adjacent each other and that are connected to a divider member. By having two sets of fan blades, the set of fan blades encircling one of the internal cavities of the blower wheel can have a different fan blade configuration than those of the other set of fan blades. More specifically, one set of fan blades can define a smaller internal diameter (and hence, smaller diameter of the respective internal cavity) than does the other set of fan blades. This can improve blower efficiency in situations where a blower motor or the structure connecting a motor to support structure (e.g., to the blower housing) limits the innermost dimeter of the fan blades on one axial side of a dual inlet blower wheel. This can also improve blower efficiency in situations where the flow air provided to one of the opposite axial sides of the blower wheel is restricted upstream (for example, by the blower housing) in comparison to flow of air provided to the other side of the blower wheel.

Figure 18:
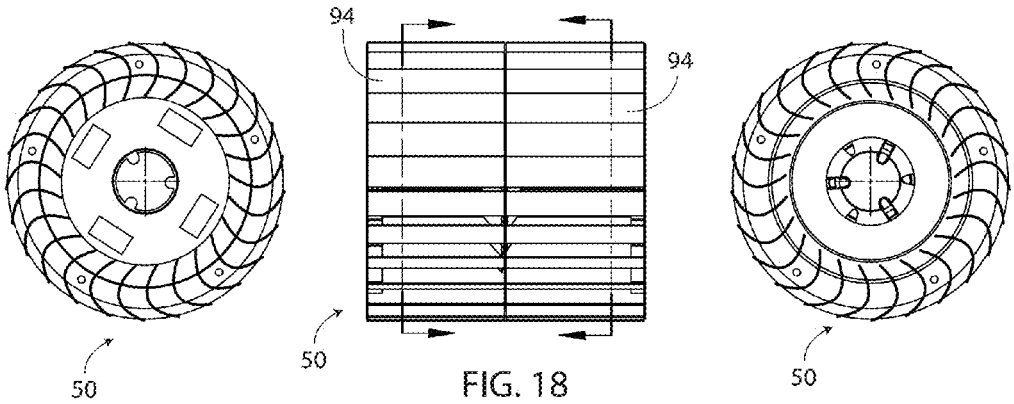
FIG. 18 depicts multiple views of a two-piece symmetric blower wheel in accordance with the invention.
Figure 19:
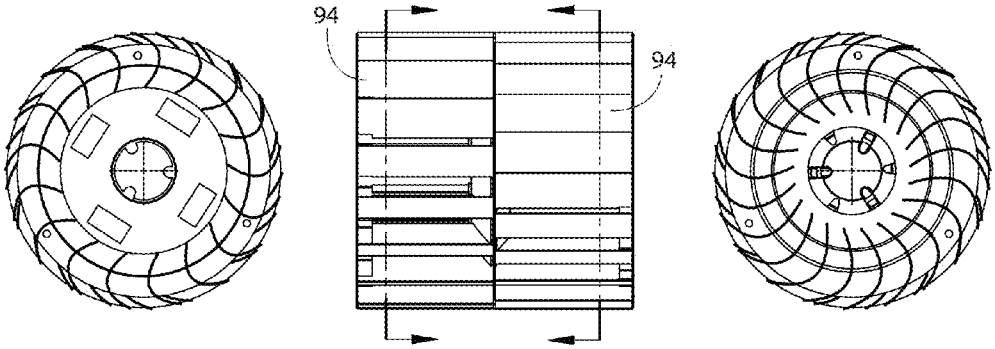
FIG. 19 depicts multiple views of a two-piece asymmetric blower wheel in accordance with the invention.
Figure 20:
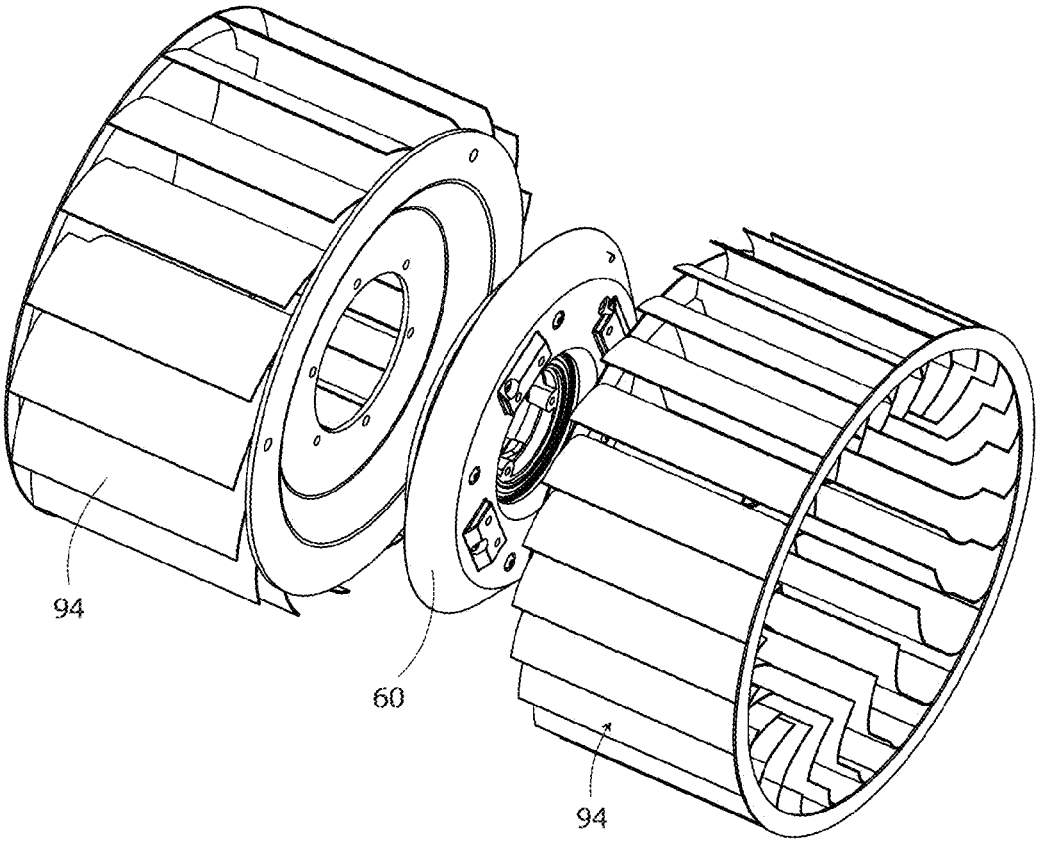
FIG. 20 depicts an exploded assembly perspective view of a two-piece asymmetric blower wheel, with an axial motor between the two blower wheel pieces.

A two-piece symmetric blower wheel in accordance with the invention is shown in FIG. 18 and a two-piece asymmetric blower wheel in accordance with the invention is shown in FIGS. 19 and 20. Both of such blower wheels are similar in function to the single-piece symmetric and single-piece asymmetric blower wheels described above, respectively. As shown in the exploded view of FIG. 20, the two blower wheel pieces 94 of such blower wheels are particularly useful in connection with blower wheels having a completely internal axial motor. With such blower wheels, the axial motor can be sandwiched between the two blower wheel pieces 94, thereby allowing the two blower wheel pieces 94 to be configured with internal cavities having a smaller diameter than that of the blower motor. This can provide greater blower wheel efficiency in blower assemblies having axial motors internal to a blower wheel.

Regardless of whether a blower wheel in accordance with the invention has one or two sets of blades or whether two sets of blades of a blower wheel are configured to define identical inner diameters, each set of fan blades preferably has a solidity that falls within a range of 1.0 to 2.0. The solidity of a blower wheel is defined as the chord length of the fan blades of set of fan blades multiplied by the number of fan blades of that set, divided by the product of the outer dimeter of the set of fan blades multiplied by pi. Even more preferably, the solidity of any given set of fan blades falls within the range of 1.25 to 1.75. Thus, it should be appreciated that for asymmetric dual inlet blower wheels having sets of fan blades of that define appreciably different internal diameters, the number of fan blades of one set of fan blades is preferably different than the number of fan blades of the other set, so as to a achieve the desired solidity for each of the sets of fan blades.

In view of the foregoing, it should be appreciated that the invention has several advantages over the prior art.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed, unless such an order is inherent or explicit.

What is claimed is:

1. A forward-curved blower wheel comprising a divider or end member and a plurality of fan blades circumferentially spaced about a fan axis, the blower wheel having a blower wheel inlet that is defined by the fan blades, each of the fan blades having a leading edge, a trailing edge, and a mean camber line, the mean camber line extending from the leading edge to the trailing edge, the leading edges of the fan blades collectively defining an inner diameter of the blower wheel and the trailing edges of the fan blades defining an outer diameter of the blower wheel, the mean camber line of each of the fan blades having a blade angle that increases as the mean camber line extends from the leading edge to the trailing edge of the respective fan blade, the leading edge of each of the fan blades being a distance from the trailing edge of the fan blade, the distance constituting a chord length, the blade angle of the mean camber line of each of the fan blades being at most seventy-seven and at least thirty degrees at the leading edge of the respective fan blade, the inner diameter, the blower wheel inlet, and the divider or end member bounding an internal cavity of the blower wheel, the internal cavity having an axial width, a majority of the fan blades each comprising a first leading edge notch adjacent the blower wheel inlet, the first leading edge notch having an area greater than 0.045 and less than 0.64 times the square of the chord length within a distance equal to twenty-five percent of the axial width of the internal cavity from the blower wheel inlet.

2. A forward-curved blower wheel in accordance with claim 1 wherein the plurality of fan blades consist of a first number of fan blades that are the only fan blades that are spaced about the fan axis adjacent the blower wheel inlet, and the product of the first number multiplied by the chord length is greater than or equal to the product of pi multiplied by the outer diameter and less than or equal to two times the product of pi multiplied by the outer diameter.

3. A forward-curved blower wheel in accordance with claim 1 wherein the blade angle of the mean camber line of each of the fan blades is at most fifty degrees at the leading edge of the respective fan blade.

4. A forward-curved blower wheel in accordance with claim 1 wherein the mean camber line of each of the fan blades has first and second regions, the first region being between the second region and the leading edge of the respective fan blade, the blade angle increasing at an increasing rate throughout the first region of the mean camber line as the mean camber line extends away from the leading edge, the blade angle increasing at a decreasing rate throughout the second region as the mean camber line extends away from the leading edge.

5. A forward-curved blower wheel in accordance with claim 4 wherein the first region of the mean camber line has a length and the second region of the mean camber line has a length, and the length of the second region is less than the length of the first region.

6. A forward-curved blower wheel in accordance with claim 4 wherein the first region of the mean camber line extends from the leading edge to an inflection point and the second region extends from the inflection point to the trailing edge.

7. A forward-curved blower wheel in accordance with claim 6 wherein the mean camber line extends a length, and the inflection point lies between 0.5 and 0.6 times the length of the mean camber line along the mean camber line from the leading edge.

8. A forward-curved blower wheel in accordance with claim 1 wherein the ratio of the inner diameter of the blower wheel to the outer diameter of the blower wheel being at most 0.85.

9. A forward-curved blower wheel in accordance with claim 1 wherein the blower wheel inlet blower wheel constitutes a first blower wheel inlet and the internal cavity constitutes a first internal cavity, the blower wheel comprises a second blower wheel inlet that is defined by the fan blades and that is axially opposite the first blower wheel inlet, the divider or end member is a divider member that lies axially between the first and second blower wheel inlets, the inner diameter, the second blower wheel inlet, and the divider member bounding a second internal cavity of the blower wheel, the second internal cavity having an axial width, a majority of the fan blades each comprise a second leading edge notch adjacent the second blower wheel inlet, the second leading edge notch having an area greater than 0.045 and less than 0.64 times the square of the chord length within a distance equal to twenty-five percent of the axial width of the second internal cavity from the second blower wheel inlet.

10. A forward-curved blower wheel in accordance with claim 1 wherein the blower wheel inlet constitutes a first blower wheel inlet, the fan blades constitute a first set of fan blades, the inner diameter constitutes a first inner diameter, the blower wheel comprises a plurality of fan blades circumferentially spaced about the fan axis that constitute a second set of fan blades, the second set of fan blades are axially adjacent to the first set of fan blades, the first and second sets of fan blades are the only fan blades of the blower wheel, the blower wheel comprises a second blower wheel inlet that is defined by the second set of fan blades, each of the fan blades of the second set of fan blades has a leading edge and a trailing edge, the leading edges of the fan blades of the second set of fan blades define a second inner diameter that is greater than the first inner diameter, the trailing edges of the fan blades of the second set of fan blades define an outer diameter that is equal to the outer diameter defined by the first set of fan blades, and the second set of fan blades comprises more fan blades than does the first set of fan blades.

11. A forward-curved blower wheel in accordance with claim 10 wherein the internal cavity constitutes a first internal cavity, the divider or end member is a divider member that lies axially between the first and second blower wheel inlets, the inner diameter defined by the second set of fan blades, the second blower wheel inlet, and the divider member bounding a second internal cavity of the blower wheel, the leading edge of each of the fan blades of the second set of fan blades being a distance from the trailing edge of the respective fan blade, the distance constituting a chord length, a majority of the fan blades of the second set of fan blades each comprise a second leading edge notch adjacent the second blower wheel inlet, the second leading edge notch having an area greater than 0.045 and less than 0.64 times the square of the chord length of the second set of fan blades within a distance equal to twenty-five percent of the axial width of the second internal cavity from the second blower wheel inlet.

12. A blower fan assembly comprising:

a housing, the housing comprising a housing inlet having a diameter;

a blower motor; and a blower wheel in accordance with claim 1, the blower wheel being positioned at least partially within the blower housing, the blower wheel being operatively connected to the blower motor in a manner such that the blower motor can rotationally drive the blower wheel relative to the housing, the blower wheel inlet being axially aligned with and operatively connected to the housing inlet, the inner diameter of the blower wheel being smaller than the diameter of the housing inlet, the diameter of the housing inlet squared divided by the inner diameter of the blower wheel squared being greater than 1.05.

13. A blower fan assembly in accordance with claim 12 wherein the plurality of fan blades consist of a first number of fan blades that are the only fan blades that are spaced about the fan axis adjacent the blower wheel inlet, and the product of the first number multiplied by the chord length is greater than or equal to the product of pi multiplied by the outer diameter and less than or equal to two times the product of pi multiplied by the outer diameter.

14. A blower fan assembly in accordance with claim 12 wherein the mean camber line of each of the fan blades has first and second regions, the first region being between the second region and the leading edge of the respective fan blade, the blade angle increasing at an increasing rate throughout the first region of the mean camber line as the mean camber line extends away from the leading edge, the blade angle increasing at a decreasing rate throughout the second region as the mean camber line extends away from the leading edge.

15. A blower fan assembly in accordance with claim 14 wherein the first region of the mean camber line has a length and the second region of the mean camber line has a length, and the length of the second region is less than the length of the first region.

16. A blower fan assembly in accordance with claim 14 wherein the first region of the mean camber line extends from the leading edge to an inflection point and the second region extends from the inflection point to the trailing edge.

17. A blower fan assembly in accordance with claim 16 wherein the mean camber line extends a length, and the inflection point lies between 0.5 and 0.6 times the length of the mean camber line along the mean camber line from the leading edge.

18. A forward-curved blower wheel comprising a divider or end member and a plurality of fan blades circumferentially spaced about a fan axis, the blower wheel having a blower wheel inlet that is defined by the fan blades, each of the fan blades having a leading edge, a trailing edge, and a mean camber line, the mean camber line extending from the leading edge to the trailing edge, the leading edges of the fan blades defining an inner diameter (ID) of the blower wheel and the trailing edges of the fan blades defining an outer diameter (OD) of the blower wheel, the mean camber line of each of the fan blades having a blade angle ($\alpha$, degrees) that increases as the mean camber line extends from the leading edge to the trailing edge of the respective fan blade, the blade angle of the mean camber line of each of the fan blades being at most seventy-seven degrees and at least thirty degrees at the leading edge of the respective fan blade, the mean camber line of each of the fan blades having first and second regions, the first region being between the second region and the leading edge of the respective fan blade, the blade angle increasing at an increasing rate throughout the first region of the mean camber line as the mean camber line extends away from the leading edge, the blade angle increasing at a decreasing rate throughout the second region as the mean camber line extends away from the leading edge, the first region being between the second region and the leading edge of the respective fan blade, the leading edge of each fan blade being a distance from the trailing edge of said fan blade, the distance constituting a chord length (C), the inner diameter, the blower wheel inlet, and the divider or end member bounding an internal cavity of the blower wheel, the internal cavity having an axial width, the fan blades being configured such that:

$$0 < \frac{[90 - \alpha\ (\text{at leading edge})] \cdot [C\ (\text{in}) - 1.09] \cdot ID\ (\text{in})}{\alpha\ (\text{at trailing edge}) \cdot OD\ (\text{in})} < 4,$$

the outer diameter being less than twelve inches and greater than nine inches, the product of the number of fan blades multiplied by the chord length being greater than or equal to the product of pi multiplied by the outer diameter and less than or equal to two times the product of pi multiplied by the outer diameter, a majority of the fan blades each comprising a first leading edge notch adjacent the blower wheel inlet, the first leading edge notch having an area greater than 0.045 and less than 0.64 times the square of the chord length within a distance equal to twenty-five percent of the axial width of the internal cavity from the blower wheel inlet.

19. A forward-curved blower wheel in accordance with claim 18 wherein the first region of the mean camber line extends from the leading edge to an inflection point and the second region extends from the inflection point to the trailing edge.

20. A forward-curved blower wheel in accordance with claim 19 wherein the mean camber line extends a length, and the inflection point lies between 0.5 and 0.6 times the length of the mean camber line along the mean camber line from the leading edge.

21. A blower fan assembly comprising:

a housing, the housing comprising a housing inlet having a diameter;

a blower motor; and a blower wheel in accordance with claim 18, the blower wheel being positioned at least partially within the blower housing, the blower wheel being operatively connected to the blower motor in a manner such that the blower motor can rotationally drive the blower wheel relative to the housing, the blower wheel inlet being axially aligned with and operatively connected to the housing inlet, the inner diameter of the blower wheel being smaller than the diameter of the housing inlet, the diameter of the housing inlet squared divided by the inner diameter of the blower wheel squared being greater than 1.05.

22. A forward-curved blower wheel in accordance with claim 18 wherein the blower wheel inlet constitutes a first blower wheel inlet, the divider or end member is a divider member, the internal cavity constitutes a first internal cavity, the blower wheel comprises a second blower wheel inlet that is defined by the fan blades and that is axially opposite the first blower wheel inlet, the inner diameter, the second blower wheel inlet, and the divider member bounding a second internal cavity of the blower wheel, the second internal cavity having an axial width, a majority of the fan blades each comprise a second leading edge notch adjacent the second blower wheel inlet, and the second leading edge notch has an area greater than 0.045 and less than 0.64 times the square of the chord length within a distance equal to twenty-five percent of the axial width of the second internal cavity from the second blower wheel inlet.

23. A forward-curved blower wheel in accordance with claim 18 wherein the blower wheel inlet constitutes a first blower wheel inlet, the inner diameter constitutes a first inner diameter, the fan blades constitute a first set of fan blades, the blower wheel comprises a plurality of fan blades circumferentially spaced about the fan axis that constitute a second set of fan blades, the second set of fan blades are axially adjacent to the first set of fan blades, the first and second sets of fan blades are the only fan blades of the blower wheel, the blower wheel comprises a second blower wheel inlet that is defined by the second set of fan blades, each of the fan blades of the second set of fan blades has a leading edge and a trailing edge, the leading edges of the fan blades of the second set of fan blades define a second inner diameter that is greater than the first inner diameter, the trailing edges of the fan blades of the second set of fan blades define an outer diameter that is equal to the outer diameter defined by the first set of fan blades, and the second set of fan blades comprises more fan blades than does the first set of fan blades.

24. A forward-curved blower wheel comprising a divider member and a first set of a plurality of fan blades circumferentially spaced about a fan axis, the blower wheel having a first blower wheel inlet that is defined by the first set of the fan blades, each of the fan blades of the first set of fan blades having a leading edge and a trailing edge, the leading edges of the fan blades of the first set of fan blades defining a first inner diameter of the blower wheel and the trailing edges of the fan blades defining an outer diameter of the blower wheel, the leading edge of each of the fan blades of the first set of fan blades being a distance from the trailing edge of said fan blade, the distance constituting a first chord length, the first inner diameter, the first blower wheel inlet, and the divider member bounding a first internal cavity of the blower wheel, the first internal cavity having a first axial width, a majority of the fan blades of the first set of fan blades each comprising a first leading edge notch adjacent the first blower wheel inlet, the first leading edge notch having an area greater than 0.045 and less than 0.64 times the square of the first chord length within a distance equal to twenty-five percent of the first axial width of the first internal cavity from the first blower wheel inlet, the blower wheel comprising a second set of a plurality of fan blades circumferentially spaced about the fan axis, the second set of fan blades being axially adjacent to the first set of fan blades, the first and second sets of fan blades being the only fan blades of the blower wheel, the blower wheel comprising a second blower wheel inlet that is defined by the second set of fan blades, each of the fan blades of the second set of fan blades having a leading edge and trailing edge, the leading edges of the fan blades of the second set of fan blades defining a second inner diameter of the blower wheel that is greater than the first inner diameter, the trailing edges of the fan blades of the second set of fan blades defining an outer diameter that is equal to the outer diameter defined by the first set of fan blades, the number of fan blades the second set of fan blades being greater than the number of fan blades of the first set of fan blades.

* * * * *